US006957456B2

(12) United States Patent
Darling et al.

(10) Patent No.: US 6,957,456 B2
(45) Date of Patent: Oct. 25, 2005

(54) BED LIFT

(75) Inventors: Ronald J. Darling, Sussex, WI (US); Patrick J. Bartels, Sussex, WI (US)

(73) Assignee: JaRon, LLC, Sussex, WI (US)

( * ) Notice: Subject to any disclaimer, the term of this patent is extended or adjusted under 35 U.S.C. 154(b) by 0 days.

(21) Appl. No.: 10/708,147

(22) Filed: Feb. 11, 2004

(65) Prior Publication Data

US 2005/0172403 A1 Aug. 11, 2005

(51) Int. Cl.[7] ..... A47C 19/04
(52) U.S. Cl. ..... 5/509.1; 5/658
(58) Field of Search ..... 5/509.1, 660, 634, 5/610, 616, 617, 658

(56) References Cited

U.S. PATENT DOCUMENTS

| | | | | |
|---|---|---|---|---|
| 2,887,691 A | * | 5/1959 | Talarico et al. | 5/610 |
| 4,376,316 A | * | 3/1983 | Mercier et al. | 5/618 |
| 4,715,073 A | | 12/1987 | Butler | |
| 4,819,282 A | | 4/1989 | McArthur et al. | |
| 4,856,129 A | | 8/1989 | Butler | |
| 4,934,007 A | | 6/1990 | Sweet | |
| 4,942,633 A | | 7/1990 | Thomas et al. | |
| 5,074,000 A | | 12/1991 | Soltani et al. | |
| 5,090,070 A | | 2/1992 | Heinz | |
| 5,294,179 A | * | 3/1994 | Rudes et al. | 297/330 |
| 5,317,769 A | | 6/1994 | Weismiller et al. | |
| 5,418,987 A | | 5/1995 | Yoshino | |
| 5,566,412 A | | 10/1996 | Arnold | |
| 5,594,961 A | | 1/1997 | Yokoi et al. | |
| 5,720,059 A | | 2/1998 | Allevato et al. | |
| 6,058,532 A | | 5/2000 | Allen | |
| 6,108,838 A | | 8/2000 | Connolly et al. | |
| 6,230,344 B1 | | 5/2001 | Thompson et al. | |
| 6,405,393 B2 | | 6/2002 | Megown | |
| 6,516,478 B2 | | 2/2003 | Cook et al. | |

FOREIGN PATENT DOCUMENTS

EP 323626 A1 * 7/1989 ..... A47C 19/00

OTHER PUBLICATIONS

PROMA REHA s.r.o., "Mechanical abjustable beds", http://www.promareha.cz/eng/textver/mluzka.thm, pp. 1-2.
PROMA REHA s.r.o., "Mechanical abjustable bed PL-90MC", http://www.promareha.cz/eng/textver/pl90mc.htm, p. 1.
Bestway Bedding, "Bestway Hotel/Motel Bedding", http://www.bestwaybedding.com/hotel.html, 2002, p. 1.

* cited by examiner

*Primary Examiner*—Robert G. Santos
(74) *Attorney, Agent, or Firm*—Ziolkowski Patent Solutions Group, SC

(57) ABSTRACT

An apparatus and method for tilting a bed frame is disclosed. The apparatus raises and lowers an end of a bed frame between a horizontal position and an inclined position. The apparatus includes a power actuator connected to an extendable support bar. To raise or incline the bed, a support end of the extendable support bar contacts the floor while a lifting end raises the bed frame as the power actuator causes the extendable support bar to move from a retracted position toward an extended position. As the distance between the lifting end of the extendable support bar and the floor increases, the extendable support bar inclines the bed. To increase the rate at which the bed is inclined, ramps are placed between the extendable support bar and the bed.

33 Claims, 3 Drawing Sheets

BED LIFT

BACKGROUND OF INVENTION

The present invention relates generally to an inclinable bed frame and, more particularly, to a tilting apparatus for elevating a bed frame between a horizontal position and an inclined position.

It is often advantageous to incline one end of a bed. For example, an individual may be temporarily relieved from pain and other symptoms caused by digestive disorders such as gastro-esophageal reflux and heartburn by maintaining the head slightly above the rest of the body while sleeping or lying down. An individual may also find it desirable to be inclined when reading, writing or watching television in bed. This may be particularly true of business people and other travelers staying in hotels while away from home.

Numerous methods have been employed to incline a bed frame. Books or bricks can be placed under the legs or supports of the bed frame. This method is often tedious and may require the assistance of another person. This method may also be aesthetically unpleasing. Further, using bricks or books as an elevation device restricts movement of the bed should it be desired to re-position the bed to another location. Using bricks and books may also result in an unstable frame position thereby exposing a person resting on the bed to injury. Additionally, to raise or lower the frame one may be required to exit the bed, which may not be possible given the infirmity of the individual.

Other methods and systems have been developed to incline a bed frame and typically include the use of actuators coupled to various types of support systems. Using actuators to assist in raising one end of the bed helps remove the patient from the physical labor of raising one end of the bed manually. However, many of these methods create structures that are often large in size or complicated to use and may require the use of a specialized bed frame. Furthermore, many of these methods leave the tilting mechanisms exposed where damage to fingers or other objects may result as the bed is being raised or lowered.

Other solutions include an integrated bed frame and bed that is designed to incline at one or more points between the head and foot ends of the bed. This solution, however, requires a specialized bed and frame and may be cost prohibitive to some individuals and especially lodging chains that must equip dozens, if not hundreds, of bedrooms with one or more beds.

It would therefore be desirable to have a system and method capable of tilting one end of a conventional bed frame so as to incline a conventional bed. It would be further desirable to have a tilting apparatus that may be used to retrofit an existing bed frame to be inclinable.

BRIEF DESCRIPTION OF INVENTION

The present invention provides a system and method of elevating or tilting one end of a conventional bed frame that overcomes the aforementioned drawbacks. A tilting apparatus is attached to an end of a new or existing bed frame to tilt the end of the bed. A power actuator has a shaft which is connected to and moves a first end of a lifting bar. The other end of the lifting bar rests on the floor, and its movement is restricted. As the shaft moves the first end of the lifting bar, the distance between the first end of the lifting bar and the floor is increased or decreased. The first end of the lifting bar raises and lowers the tilting apparatus connected to the bed frame thereby tilting the bed frame.

Therefore, in accordance with one aspect, the present invention includes an inclinable apparatus having a support bar extending across and connected to a frame. The lifting mechanism also has a power actuator connected to the support bar and an extendable bar pivotally connected to the support bar. Furthermore, the lifting mechanism has a guide bar having a ramp and constructed to engage the extendable bar. The ramp is constructed to increase a distance from the extendable bar to the guide bar during extension of the extendable bar.

According to another aspect, the present invention includes a bed having a frame and a tilting apparatus connected to the frame and constructed to retractably lift an end of the bed. The tilting apparatus includes a transverse frame bar connected to the frame and a lifting actuator having a retractable shaft connected to the transverse frame bar. The bed also has a pair of guide rails, each having a first end connected to the transverse frame bar and a second end connected to the frame. The tilting apparatus includes a pair of pivot bars, each having a first end pivotably connected to the transverse frame bar and a second end. The tilting apparatus further includes a cross member link having a first end pivotally connected to the second end of each of the pivot bars and a second end in contact with each of the guide rails.

According to yet another aspect, the present invention provides a method of manufacturing a frame tilting apparatus. The manufacturing process includes providing a main support bar and connecting an actuator having a shaft to the main support bar. A cross member bar is connected to the shaft. The cross member bar is configured to tilt a frame as the cross member bar rotates about a first end thereof. Further, the manufacturing process includes connecting a pair of rails to the main support bar. The pair of rails is configured to guide a second end of the cross member bar as the cross member bar moves therealong.

According to a further aspect, the present invention provides a method of inclining a bed includes the step of engaging a first end of an extendable bar to a guide bar fixedly attached to one end of a bed frame. A second end of the extendable bar is engaged to a floor. The first end of the extendable bar is extended such that the extendable bar rotates causing a distance between the first end of the extendable bar and the floor to increase. A distance between the first end of the extendable bar and the guide bar is increased as the first end of the extendable bar moves along a ramp attached to the guide bar.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
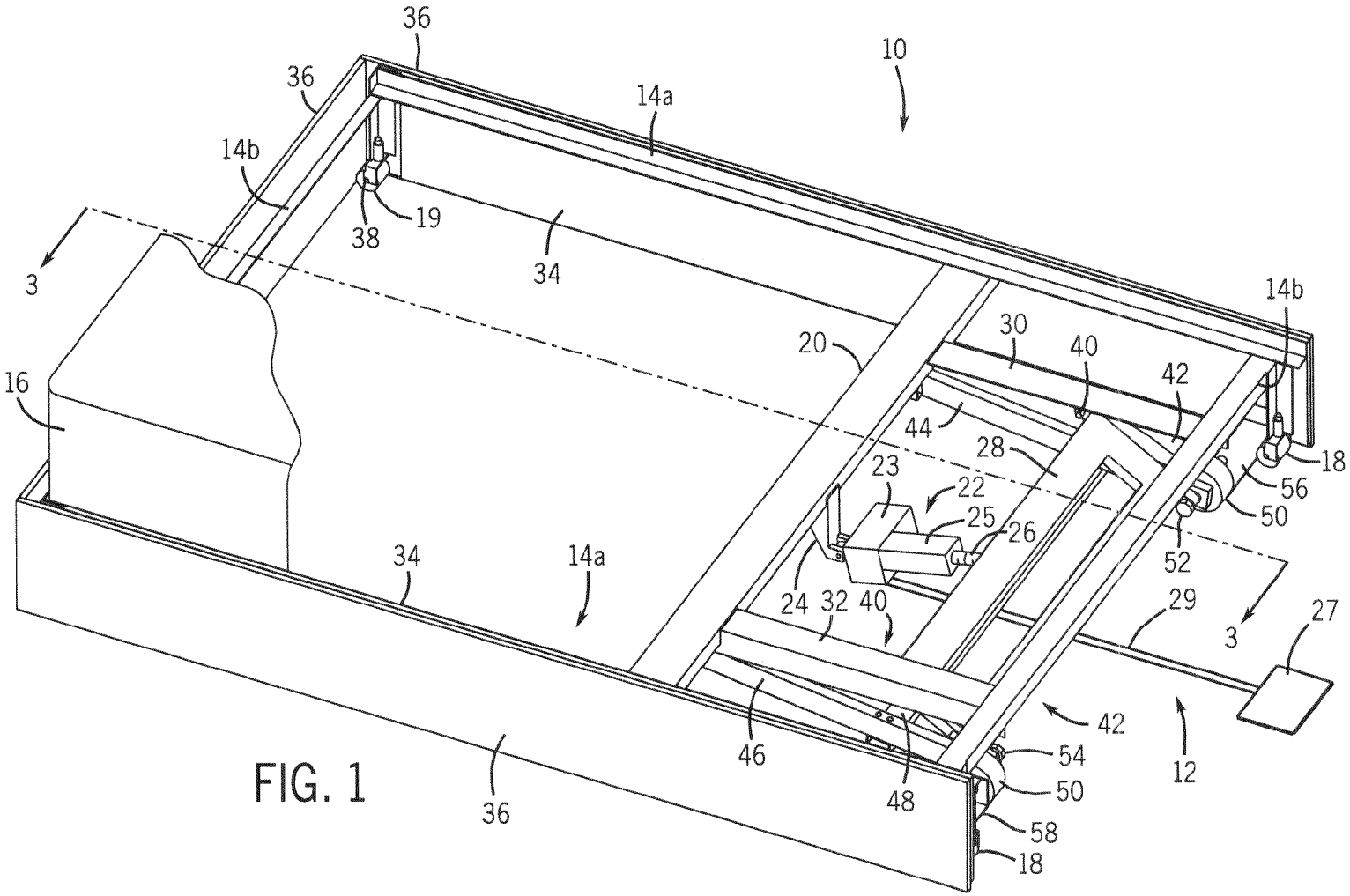
FIG. 1 is a perspective view of a bed incorporating a frame tilting apparatus according to the present invention.

Referring now to FIG. 1, an inclinable bed 10 in accordance with the present invention is shown. The inclinable bed 10 includes a tilting apparatus 12, which will be described in greater detail with respect to FIG. 2. The tilting apparatus 12 is connected to a conventional mattress frame 14. Frame 14 is designed to support a mattress or box spring mattress combination and includes a pair of frame rails 14*a* and a pair of transverse frame bars 14*b*. The frame 14 is configured to receive a mattress 16 of conventional mattress size, e.g. twin double, queen, king, and the like. The mattress 16 may also be supported by plywood or other planar support. A set of castor wheels 18, 19 is attached to the frame 14 to allow movement and repositioning of the bed. The inclinable bed 10 includes at least one tilting apparatus. That is, it is contemplated that two or more tilting apparatus 12 may be used for inclination of larger sized or greater weight mattresses and support structures.

Figure 2:
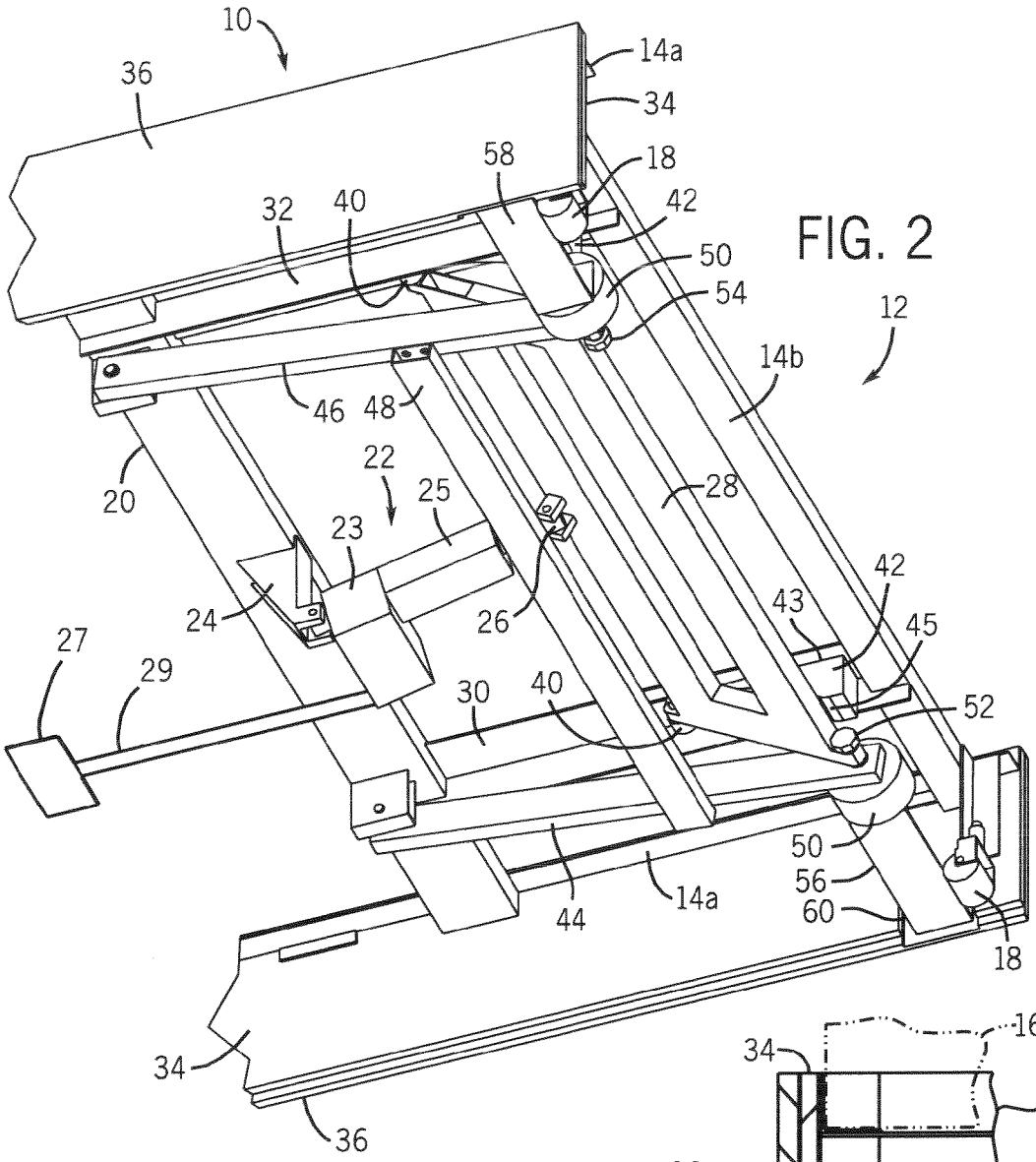
FIG. 2 is a perspective view of the frame tilting apparatus shown in FIG. 1.

Referring now to FIG. 2, tilting apparatus 12 has a cross member support or link 20 that spans the width of the frame 14. Preferably, the cross member support 20 is secured to the frame 14 using bolts (not shown) or other threaded fasteners. A power actuator 22 is attached to the cross member support 20 by way of an actuator support or bracket 24. The power actuator 22 includes a motor/pump and control housing 23 having a controller and motor/pump (not shown) therein, a retractable cylinder, screw, or shaft 26 (FIG. 1), and a cylinder, screw, or shaft housing 25. The retractable shaft 26 is designed to extend from and retract into the housing 25. The power actuator 22 may be of the mechanical, electrical, pneumatic, hydraulic, or similar type. Electrical power required by the power actuator 22 may be supplied by a battery (not shown) located internally or externally to the housing 23 or by connecting the power actuator 22 to a utility power source via a conventional wall outlet (not shown).

The power actuator 22 is preferably remotely controlled via actuator controller 27. Remote control 27 actuates the power actuator to extend or retract the shaft 26 between a minimum position and a maximum position. It is contemplated that the shaft 26 may be extended to a position between a plurality of extended positions between the minimum and maximum positions and maintain that position as desired. In this regard, the frame may be caused to incline at any of a myriad of incline positions. Remote control 27 is linked to the actuator controller via a cable 29 or communicates with the controller wirelessly. The shaft 26 is pivotably attached to an extendable bar 28 and moves the extendable bar 28 along a pair of guide rails 30, 32. The minimum and maximum positions of shaft 26 limit the range of motion of the extendable bar 28 along the pair of guide rails 30, 32. The shaft 26 also is placed in a lock position so as to restrict movement of the extendable bar 28 when a desirable inclined position is reached.

Still referring to FIG. 2, the shaft 26 is pivotably attached to the extendable bar 28 so as to allow the extendable bar 28 to rotate as the extendable bar 28 moves along guide rails 30, 32. To help reduce friction as the extendable bar 28 moves along guide rails 30, 32, the extendable bar 28 has a pair of guide wheels 40 pivotably attached and constructed to roll in the guide rails 30, 32. It is also contemplated that magnets may be used instead of guide wheels to assist in reducing friction. Guide rails 30, 32 attach at one end to cross member support 20 and to frame 14 at the other end. Guide rails 30, 32 are designed to guide the movement of one end of the extendable bar 28 as the frame 14 is raised or lowered. Additionally, well-defined channels may also be formed in the guide rails 30, 32 to help guide wheels 40.

A pair of ramps 42 may be seated in guide rails 30, 32 along the path of guide wheels 40 to define the rate of incline of frame 14 as the extendable bar 28 moves along guide rails 30, 32 and to increase the distance between extendable bar 28 and guide rails 30, 32. Preferably, ramps 42 have a flat surface 43 mounted to guide rails 30, 32 and an arcuate surface 45 opposite thereof. In a preferred embodiment, ramps 42 are configured to increase the distance between guide wheels 40 and guide rails 30, 32 as the extendable bar 28 is extended. In this manner, ramps 42 may be constructed such that frame 14 is inclined at a substantially constant or linear rate. It is also contemplated that the speed at which the shaft 26 is extended and retracted may be varied so as to achieve the desired rate of incline.

Tilting apparatus 12 further includes support legs 44, 46. Each leg 44, 46 is pivotably attached at one end to the cross member support 20 and is pivotably attached at the other end to the extendable bar 28. A stabilizing crossbar 48 is fixably attached to the legs 44, 46 to provide additional support. A set of wheels 50 is attached to the extendable bar 28 and legs 44, 46 with pins 52, 54. The set of wheels 50 is configured to support the inclinable bed 10 on the floor surface as the frame 14 and bed 10 are raised or lowered.

The inclinable bed 10 also includes an inner guard 34 and an outer guard 36 that surround the sides and foot end of the frame 14. It is contemplated that a wall or headboard structure guards the head end of the bed. Guard 34 is attached to frame 14 and, as such, moves with the frame 14 as the inclinable bed 10 is raised or lowered. Outer guard 36 is attached to the extendable bar 28 and to support pins 38. In this regard, the outer guard 36 remains in a fixed and substantially horizontal position as the frame 14 is raised and lowered.

Guard supports 56, 58 are attached to legs 44, 46 at pins 52, 54. The guard supports 56, 58 support the outer guard 36 and keep the outer guard 36 in a substantially horizontal position throughout the tilting range of the tilting apparatus 12. As shown in FIG. 2, a cutout 60 in the inner guard 34 allows the guard supports 56, 58 to extend through the plane of the inner guard 34 and attach to the outer guard 36.

Figure 3:
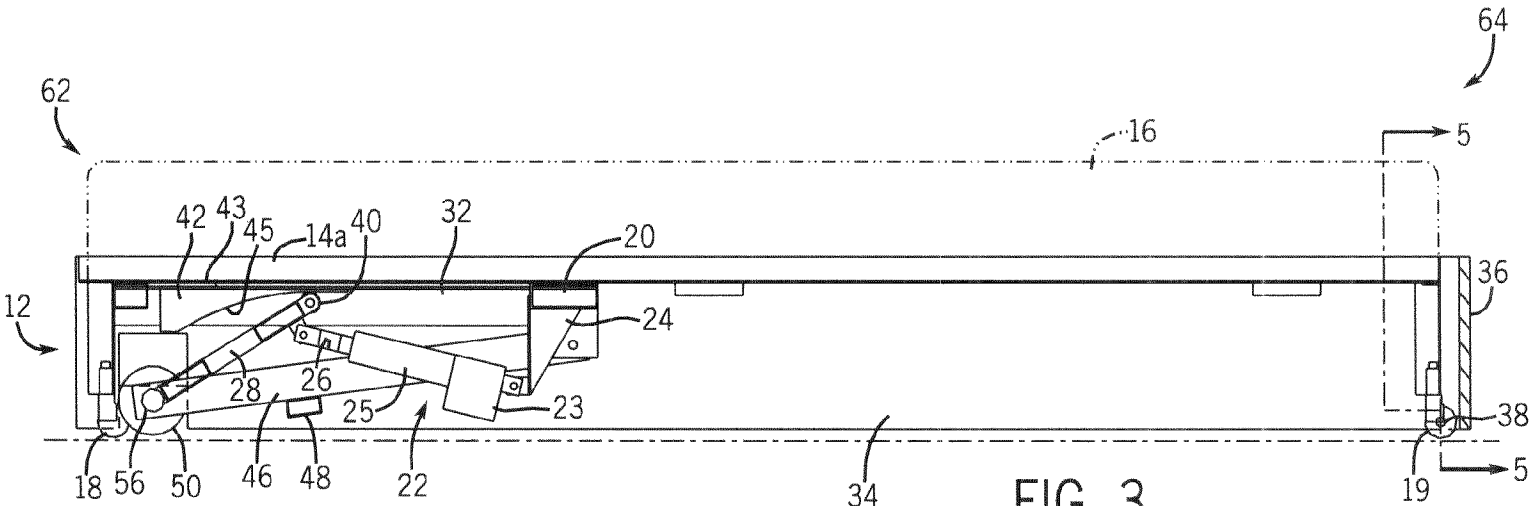
FIG. 3 is a cross-sectional view taken along lines 3—3 of FIG. 1 illustrating the bed in a horizontal position.

Referring now to FIG. 3, a cross-sectional view of FIG. 1 shows the inclinable bed 10 in a horizontal or rest position. The shaft 26 of the power actuator 22 and the extendable bar 28 are shown in a retracted position. In this position, the castor wheels 18, 19 support the frame 14 on the floor, and support wheel 50 is raised off the floor allowing the head end 62 and foot end 64 of the frame 14 to be re-positioned in any direction along the floor. Inner guard 34 and outer guard 36 are in a horizontal position such that the outer guard 36 completely overlaps the inner guard 34.

Figure 4:
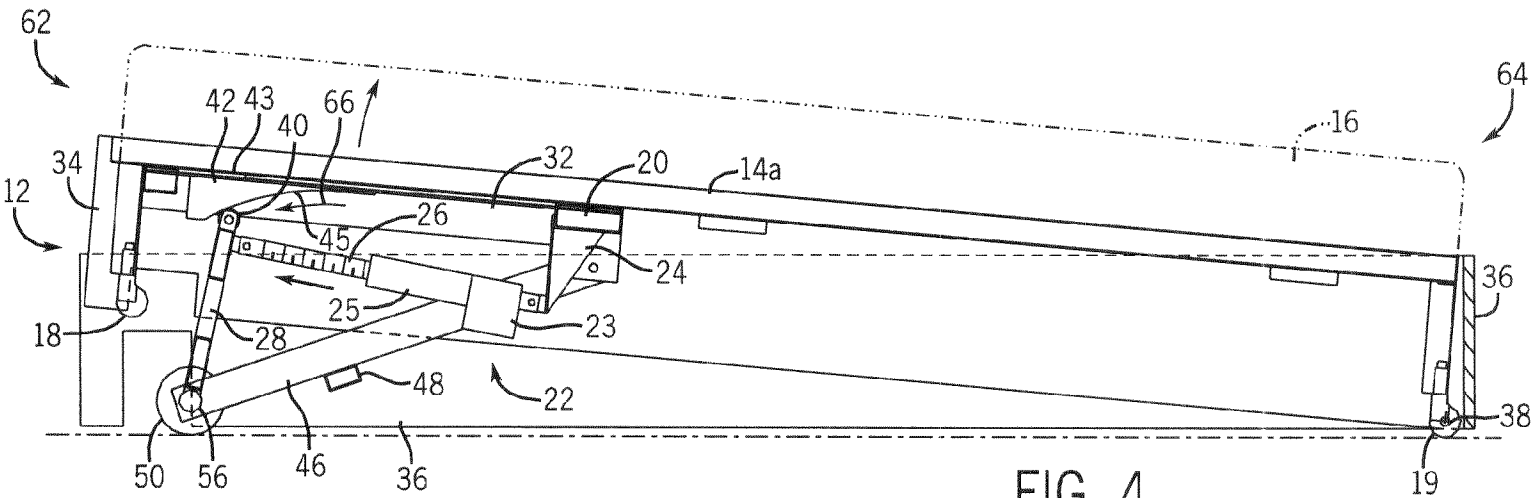
FIG. 4 is a cross-sectional view, similar to FIG. 3, with the bed in an inclined position.

Referring now to FIG. 4, as the power actuator 22 extends shaft 26, the extendable bar 28 rotates about the pin 54 from the retracted position toward the extended position, and the extendable bar 28 becomes increasingly perpendicular to the floor. As the extendable bar 28 rotates, guide wheel 40 travels along the guide rail 32 in a direction generally indicated by arrow 66. The guide wheels 40 force the head end 62 of frame 14 away from the floor or supporting surface as the extendable bar 28 increases the distance between the floor and guide wheel 40. To extend the distance between the head end 62 of frame 14 and the floor, ramp 42 is attached to the guide rail 32 and placed in the path along which guide wheels 40 travel.

Support wheels 50 contact the floor and support the extendable bar 28 as the extendable bar 28 is extended.

Castor wheels 18, located at the head end 62 of frame 14, are raised off the floor as frame 14 is tilted. It is contemplated, however, that the castor wheels may be constructed to remain in contact with the floor as the frame is tilted. Support wheels 50 and castor wheels 19, located at the foot end 64, support the frame 14 on the floor and allow re-positioning of frame 14 while in an inclined position.

As mentioned above, inner guard 34 is attached to frame 14 and inclines with frame 14. Outer guard 36 remains in a substantially horizontal position with respect to the floor as frame 14 is tilted. Inner guard 34 and outer guard 36 remain overlapped as frame 14 moves from a horizontal position to a tilted position to prohibit interference with the tilting apparatus 12.

Figure 5:
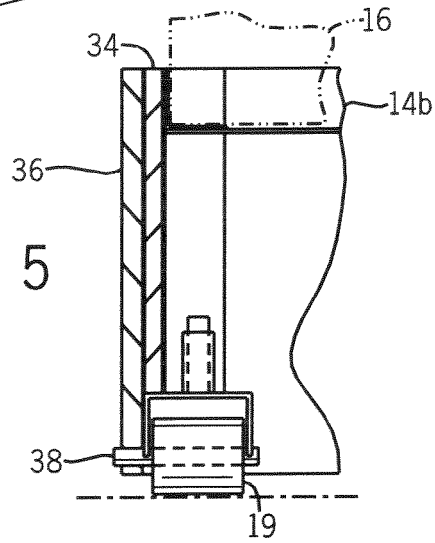
FIG. 5 is a cross-sectional view taken along lines 5—5 of FIG. 3.

Referring now to FIG. 5, a view of FIG. 3 taken along lines 5—5 thereof illustrates the relative position of guards 34, 36 when the frame is at a rested or non-inclined position. As further shown, a support pin 38 extends through castor wheel 19 to the outer guard 36. Support pin 38 maintains the outer guard 36 off the floor to ease the portability of the bed 10. As noted, guard 36 will remain fixed as the frame is inclined. Guard 34 will follow the inclination of the frame 14. The guards 34, 36 are of sufficient size to block or prevent insertion of objects in the volume defined by the tilting apparatus.

Therefore, in accordance with one embodiment, the present invention includes an inclinable apparatus having a support bar extending across and connected to a frame. The lifting mechanism also has a power actuator connected to the support bar and an extendable bar pivotally connected to the support bar. Furthermore, the lifting mechanism has a guide bar having a ramp and constructed to engage the extendable bar. The ramp is constructed to increase a distance from the extendable bar to the guide bar during extension of the extendable bar.

According to another embodiment, the present invention includes a bed having a frame and a tilting apparatus connected to the frame and constructed to retractably lift an end of the bed. The tilting apparatus includes a transverse frame bar connected to the frame and a lifting actuator having a retractable shaft connected to the transverse frame bar. The bed also has a pair of guide rails, each having a first end connected to the transverse frame bar and a second end connected to the frame. The tilting apparatus includes a pair of pivot bars, each having a first end pivotably connected to the transverse frame bar and a second end. The tilting apparatus further includes a cross member link having a first end pivotally connected to the second end of each of the pivot bars and a second end in contact with each of the guide rails.

According to yet another embodiment, the present invention provides a method of manufacturing a frame tilting apparatus. The manufacturing process includes providing a main support bar and connecting an actuator having a shaft to the main support bar. A cross member bar is connected to the shaft. The cross member bar is configured to tilt a frame as the cross member bar rotates about a first end thereof. Further, the manufacturing process includes connecting a pair of rails to the main support bar. The pair of rails is configured to guide a second end of the cross member bar as the cross member bar moves therealong.

According to a further embodiment, the present invention provides a method of inclining a bed includes the step of engaging a first end of an extendable bar to a guide bar fixedly attached to one end of a bed frame. A second end of the extendable bar is engaged to a floor. The first end of the extendable bar is extended such that the extendable bar rotates causing a distance between the first end of the extendable bar and the floor to increase. A distance between the first end of the extendable bar and the guide bar is increased as the first end of the extendable bar moves along a ramp attached to the guide bar.

The present invention has been described in terms of the preferred embodiment, and it is recognized that equivalents, alternatives, and modifications, aside from those expressly stated, are possible and within the scope of the appending claims.

What is claimed is:

1. An lifting apparatus comprising:

a support bar extendable across and connectable to a frame;

a power actuator connected to the support bar;

an extendable bar pivotally connected to the power actuator; and a guide bar having a ramp and constructed to engage the extendable bar, the ramp constructed to increase a distance from the extendable bar to the guide bar during extension of the extendable bar.

2. The apparatus of claim 1 wherein the ramp increases a rate of incline during extension of the extendable bar.

3. The apparatus of claim 1 wherein the ramp has a flat surface mounted to the guide bar and an arcuate surface opposite thereof.

4. The apparatus of claim 1 wherein the ramp is generally triangular shaped.

5. The apparatus of claim 1 further comprising a first set of wheels attached to a first end of the extendable bar and constructed to move along the guide bar.

6. The apparatus of claim 5 further comprising a second set of wheels attached to a second end of the extendable bar and constructed to move along a planar surface supporting the frame.

7. The apparatus of claim 6 wherein the extendable bar varies an elevation of at least one of a head end and a foot end of the frame as the first set of wheels move along the guide bar.

8. The apparatus of claim 7 wherein the at least one of a head end and a foot end of the frame is elevated off the floor as the first set of wheels moves away from the power actuator.

9. The apparatus of claim 8 further comprising side ads connected to the frame and configured to be displaced as the elevation varies so as to prevent access to an underneath portion of the frame.

10. The apparatus of claim 1 wherein the power actuator is at least one of a mechanical, an electrical, a hydraulic, and a pneumatic device.

11. An bed comprising:

a frame;

a tilting apparatus connected to the fame and configured to lift an end of the frame, the tilting apparatus comprising:

a transverse frame bar connected to the frame;

a lifting actuator having a retractable shaft and connected to the transverse frame bar;

a pair of guide rails, each having a first end connected to the transverse frame bar and a second end connected to the frame;

a pair of pivot bars each having a first end pivotably connected to the transverse frame bar and a second end; and a cross member link having a first end pivotally connected to the second end of each of the pivot bars and a second end in contact with each of the guide rails.

12. The bed of claim 11 wherein the lifting actuator is remotely controlled.

13. The bed of claim 11 further comprising a ramp positioned on each of the pair of guide rails to engage a respective guide wheel.

14. The bed of claim 13 wherein the ramp has an arcuate surface to engage the respective guide wheel.

15. The bed of claim 11 wherein the cross member link is connected to the retractable shaft.

16. The bed of claim 15 wherein the retractable shaft is configured to move the cross member link between a minimum position and a maximum position along the pair of guide rails.

17. The bed of claim 16 wherein the retractable shaft is configured to restrict movement of the cross member link along the pair of guide rails when a desired inclined position is reached.

18. The bed of claim 11 wherein the frame accommodates at least one of a twin size mattress, a full size mattress, a queen size mattress, and a king size mattress.

19. The bed of claim 11 comprising no more than one tilting apparatus.

20. The bed of claim 11 further comprising an incline accelerator constructed to increase a rate of inclination as the cross member link moves thereacross.

21. A method of manufacturing a frame tilting apparatus, the method comprising the steps of:

providing a main support bar;

connecting an actuator having a shaft to the main support bar;

connecting a cross member bar to the shaft, the cross member bar configured to tilt a frame as the cross member bar rotates about a first end thereof; and connecting a pair of rails to the main support bar, the pair of rails configured to guide a second end of the cross member bar as the cross member bar moves therealong.

22. The method of claim 21 further comprising the step of providing a pair of guide wheels connected to the second and of the cross member bar.

23. The method of claim 22 further comprising the step of providing a pair of ramps configured to receive the pair of guide wheels and configured to define a distance between the bed frame and the pair of guide wheels as the pair of guide wheels moves therealong.

24. The method of claim 21 further comprising the step of providing guard boards configured to inhibit interference with the frame tilting apparatus or a volume defined thereby.

25. The method of claim 21 further comprising the step of providing structure to increase a rate of inclination during extension of the cross member bar.

26. A method of inclining a bed comprising:

engaging a first end of an extendable bar to a guide bar fixedly attached to one end of a bed frame;

engaging a second end of the extendable bar to a floor;

extending the first end of the extendable bar such that the extendable bar rotates causing a distance between the first end of the extendable bar and the floor to increase; and increasing a distance between the first end of the extendable bar and the guide bar as the first end of the extendable bar moves along a ramp attached to the guide bar.

27. The method of claim 26 wherein the step of engaging the first end of the extendable bar comprises the step of actuating a power device having an extendable shaft connected to the extendable bar.

28. The method of claim 27 further comprises actuating the power device remotely.

29. A lifting apparatus comprising:

a support bar extendable across and connectable to a frame;

a power actuator connected to the support bar;

an extendable bar pivotally connected to the support bar;

a guide bar having a ramp and constructed to engage the extendable bar, the ramp constructed to increase a distance from the extendable bar to the guide bar during extension of the extendable bar; and wherein the ramp has a flat surface mounted to the guide bar and an arcuate surface opposite thereof.

30. A lifting apparatus comprising:

a support bar extendable across and connectable to a frame;

a power actuator connected to the support bar;

an extendable bar pivotally connected to the support bar;

a guide bar having a ramp and constructed to engage the extendable bar, the ramp constructed to increase a distance from the extendable bar to the guide bar during extension of the extendable bar;

a first set of wheels attached to a first end of the extendable bar and constructed to move along the guide bar; and a second set of wheels attached to a second end of the extendable bar and constructed to move along a planar surface supporting the frame.

31. The apparatus of claim 30 wherein the extendable bar varies an elevation of at least one of a head end and a foot end of the frame as the first set of wheels move along the guide bar.

32. The apparatus of claim 31 wherein the at least one of a head end and a foot end of the frame is elevated off the floor as the first set of wheels moves away from the power actuator.

33. The apparatus of claim 32 further comprising side guards connected to the frame and configured to be displaced as the elevation varies so as to prevent access to an underneath portion of the frame.

* * * * *

UNITED STATES PATENT AND TRADEMARK OFFICE

CERTIFICATE OF CORRECTION

PATENT NO. : 6,957,456 B2
DATED : October 25, 2005
INVENTOR(S) : Darling et al.

It is certified that error appears in the above-identified patent and that said Letters Patent is hereby corrected as shown below:

Column 6,
Line 44, delete “ads” and substitute -- guards --.

Column 7,
Line 38, delete “and” and substitute -- end --.

Signed and Sealed this

Seventh Day of February, 2006

JON W. DUDAS
*Director of the United States Patent and Trademark Office*